US008837997B2

(12) United States Patent
Okamoto et al.

(10) Patent No.: US 8,837,997 B2
(45) Date of Patent: Sep. 16, 2014

(54) BELT DRIVING DEVICE

(75) Inventors: Shotaro Okamoto, Osaka (JP); Masaki Saka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 85 days.

(21) Appl. No.: 13/614,480

(22) Filed: Sep. 13, 2012

(65) Prior Publication Data

US 2013/0064581 A1 Mar. 14, 2013

(30) Foreign Application Priority Data

Sep. 14, 2011 (JP) ..... 2011-200600
Sep. 14, 2011 (JP) ..... 2011-200601

(51) Int. Cl.
*G03G 15/16* (2006.01)

(52) U.S. Cl.
CPC .. *G03G 15/1615* (2013.01); *G03G 2215/00143* (2013.01)
USPC ..... 399/302; 399/165; 399/303

(58) Field of Classification Search
USPC ..... 399/302, 303, 308, 313, 162, 165
See application file for complete search history.

(56) References Cited

U.S. PATENT DOCUMENTS

| | | | | |
|---|---|---|---|---|
| 7,421,239 | B2 * | 9/2008 | Kimura et al. | 399/350 |
| 7,505,725 | B2 * | 3/2009 | Katayama et al. | 399/329 |
| 2006/0100046 | A1 * | 5/2006 | Fuse | 474/101 |
| 2010/0067951 | A1 * | 3/2010 | Nakano | 399/165 |

FOREIGN PATENT DOCUMENTS

| | | | | |
|---|---|---|---|---|
| JP | 61-116616 | U | | 7/1986 |
| JP | 4-179648 | A | | 6/1992 |
| JP | 6-64773 | A | | 3/1994 |
| JP | 2000-155480 | A | | 6/2000 |
| JP | 2005-162466 | A | | 6/2005 |
| JP | 2009-151019 | A | * | 7/2009 |

* cited by examiner

*Primary Examiner* — Sophia S Chen
(74) *Attorney, Agent, or Firm* — Birch, Stewart, Kolasch & Birch, LLP

(57) ABSTRACT

A belt driving device includes an endless belt, a tension roller, a shaft member, deviation transfer members, and biasing members. The deviation transfer members are fitted over the shaft member in such a manner as to adjoin respective of opposite ends of the tension roller in an axial direction of the tension roller. Of the deviation transfer members, at least that deviation transfer member which is located on a downstream side in a deviation direction along the axial direction is movable together with the endless belt along the shaft member. Each of the biasing members has an acting end pivotally supported on an associated one of the deviation transfer members and a base end pivotally supported on an associated one of apparatus frames at a predetermined position.

6 Claims, 8 Drawing Sheets

BELT DRIVING DEVICE

CROSS REFERENCE

This Nonprovisional application claims priority under 35 U.S.C. §119(a) on Patent Application No. 2011-200600 filed in Japan on Sep. 14, 2011 and on Patent Application No. 2011-200601 filed in Japan on Sep. 14, 2011, and the entire contents of which are hereby incorporated by reference.

BACKGROUND OF THE INVENTION

The present invention relates to a belt driving device for revolving an endless belt entrained about a plurality of entraining rollers.

Among electrophotographic image forming apparatuses for example, there exists an apparatus of the type which includes an endless belt such as an intermediate transfer belt, a secondary transfer belt, and a fixing belt. One known belt driving device for revolving such an endless belt includes a plurality of entraining rollers positioned parallel with each other for entraining the endless belt thereabout and is configured to revolve the endless belt by actuating a driving roller of the entraining rollers. Such a belt driving device involves a problem that the endless belt meanders because of variations in the outer diameters of the entraining rollers due to manufacturing errors, parallelism disorders between the entraining rollers due to mounting errors, or the like. In an image forming apparatus in particular, it is critical to limit the meandering of the endless belt as much as possible because the meandering of the endless belt affects the image quality adversely.

One known technique for limiting the meandering of an endless belt is based on an electric control such as to detect the amount of deviation of the endless belt and move a meandering correction roller in accordance with a detection signal. However, such an electric control based technique, however, requires a higher parts count due to the provisions of sensors, electric circuits, driving motor and the like, which raises a problem that the structure becomes complicated while the cost becomes higher.

A technique developed in view of these problems is known which limits the meandering of an endless belt by adjusting the tension of the endless belt by means of a mechanical system without using any sensor (see Japanese Patent Laid-Open Publication No. 2005-162466 for example). According to this conventional technique described in Japanese Patent Laid-Open Publication No. 2005-162466, a tension roller is rotatably supported by an arm member. The arm member is pivotable in the running direction of the endless belt and is biased by a spring toward the downstream side in the running direction. On opposite sides of the tension roller there are provided belt contact portions. When the endless belt meanders, the endless belt is brought into contact with the belt contact portions. As the width of contact between the endless belt and each belt contact portion increases, frictional force exerted on the belt contact portion increases. It is intended that such frictional force and the biasing force of the spring should turn the tension roller to increase the tension of the endless belt.

With the conventional technique described in Japanese Patent Laid-Open Publication No. 2005-162466, however, the pivoting direction of the arm member for increasing the tension of the endless belt is the same as the running direction of the endless belt. This might make this technique unable to adjust the tension of the endless belt because increasing frictional force exerted on the belt contact portions with increasing amount of deviation of the endless belt causes the arm member to go beyond the peak and fall down on the downstream side in the running direction of the endless belt by the force of the endless belt running, with the result that the tension imparted by the tension roller to the endless belt becomes extremely weak. In order to prevent the arm member from going beyond the peak, various settings including setting of spring strength, setting of the length and mass of the arm member and like settings have to be made with difficulty. Therefore, it is difficult to correct the meandering of the endless belt stably.

Where the above-described conventional technique is applied to a belt driving device for use with an endless belt having a stretch property such as a secondary transfer belt in spite of the nature of the stretchable endless belt such that the endless belt is likely to deviate toward a higher tension side, the tension on the side toward which the endless belt deviates is increased, which causes the endless belt to meander increasingly vigorously.

A feature of the present invention is to provide a belt driving device which is capable of stably correcting the meandering of an endless belt by means of a simple mechanism.

SUMMARY OF THE INVENTION

A belt driving device according to the present invention includes an endless belt, a plurality of entraining rollers, a shaft member, deviation transfer members, and biasing members. The entraining rollers entrain the endless belt thereabout. The entraining rollers include a driving roller for revolving the endless belt and a tension roller capable of varying a tension of the endless belt. The shaft member supports the tension roller for rotation and has opposite end portions which are independently movable in such a direction as to vary the tension of the endless belt. The deviation transfer members are fitted over the shaft member in such a manner as to adjoin respective of opposite ends of the tension roller in an axial direction of the tension roller. Of the deviation transfer members, at least that deviation transfer member which is located on a downstream side in a deviation direction of the endless belt along the axial direction is movable in the deviation direction with deviation of the endless belt. The biasing members each have an elastic force which biases the shaft member in such a direction as to increase the tension of the endless belt. The biasing members each include an acting end pivotally supported on an associated one of the deviation transfer members and a base end pivotally supported on an associated one of apparatus frames.

With this arrangement, when the endless belt meanders to deviate toward one side in the axial direction of the tension roller, the deviation transfer member which is located on the downstream side in the deviation direction moves in the axial direction. This causes at least that biasing member which is located on the downstream side in the deviation direction to vary its angle of inclination relative to the axial direction thereby to vary its biasing force, thus causing the tension of the endless belt to vary at least on the downstream side in the deviation direction. In this way, meandering of an intermediate transfer belt is corrected.

According to the present invention, the meandering of an endless belt in the belt driving device can be corrected stably by means of a simple mechanism.

DETAILED DESCRIPTION OF THE INVENTION

Figure 1:
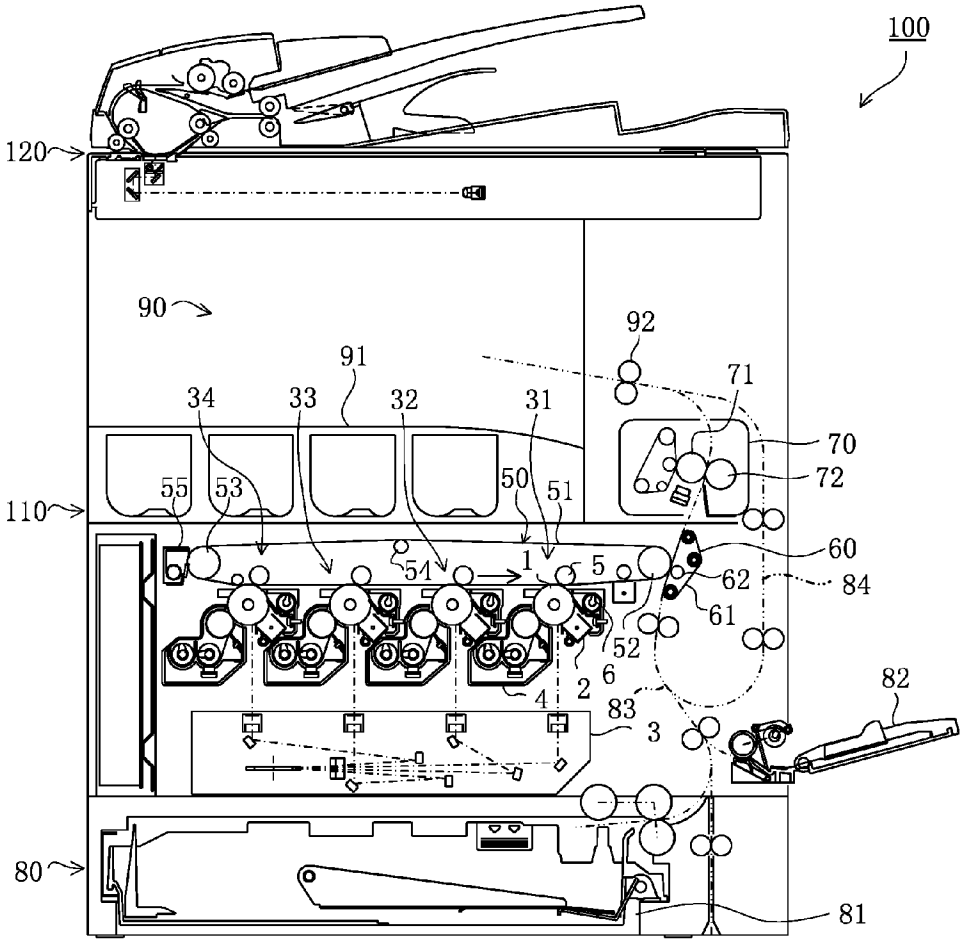
FIG. 1 is a view schematically illustrating a configuration of an image forming apparatus including an intermediate transfer unit as an embodiment of a belt driving device of the present invention.

Hereinafter, embodiments of the present invention will be described with reference to the attached drawings. Referring to FIG. 1, an image forming apparatus 100 is configured to form a monochrome or polychrome image on a recording sheet according to image data created from a document or image data transmitted thereto from the outside. Recording media, such as plain paper, printing paper and OHP film, can be used as the recording sheet.

The image forming apparatus 100 includes an image reading portion 120, an image forming portion 110, a sheet feeding portion 80, and a sheet output portion 90.

The image reading portion 120 reads an image from a document to create image data and feeds the image data to the image forming portion 110.

The image forming portion 110 includes an exposure unit 3, four image forming stations 31 to 34, an intermediate transfer unit 50, a secondary transfer unit 60, and a fixing unit 70. The image forming portion 110 is configured to carry out an image forming process on a recording sheet. The intermediate transfer unit 50 is one embodiment of the belt driving device.

The intermediate transfer unit 50 includes an intermediate transfer belt 51, an intermediate transfer belt driving roller 52, an intermediate transfer belt idle roller 53, and an intermediate transfer belt tension roller 54. The intermediate transfer belt driving roller 52, intermediate transfer belt idle roller 53 and intermediate transfer belt tension roller 54 are disposed to extend parallel with each other. The intermediate transfer belt 51 comprises resin film having no stretch property such as polyimide film. The intermediate transfer belt 51 is an endless belt which is entrained between the intermediate transfer belt driving roller 52 and the intermediate transfer belt idle roller 53 to form a looped moving path. The tension of the intermediate transfer belt 51 can be varied by the intermediate transfer belt tension roller 54. The intermediate transfer belt driving roller 52, intermediate transfer belt idle roller 53 and intermediate transfer belt tension roller 54 are entraining rollers which entrain the intermediate transfer belt 51 thereabout.

The image forming portion 110 is configured to form toner images of four colors according to image data by the respective image forming stations 31 to 34. The four colors consist of black and the three subtractive primary colors: cyan, magenta and yellow which can be obtained by color separation of a color image. The image forming stations 31 to 34 are disposed in a row along the moving path of the intermediate transfer belt 51. The image forming stations 32 to 34 are substantially similar in configuration to the image forming station 31.

The image forming station 31 configured to form a black image includes a photoreceptor drum 1, an electrostatic charger device 2, a developing device 4, an intermediate transfer roller 5, and a cleaner unit 6.

The photoreceptor drum 1, which is an electrostatic latent image baring member, is rotated in a predetermined direction by a driving power transmitted from a non-illustrated driving source. The electrostatic charger device 2 is configured to electrostatically charge the peripheral surface of the photoreceptor drum 1 to a predetermined potential.

The exposure unit 3 is configured to irradiate the photoreceptor drums 1 of the respective image forming stations 31 to 34 with laser beams modulated according to image data items corresponding to the respective colors, i.e., black, cyan, magenta and yellow. Thus, electrostatic latent images according to the image data items corresponding to the respective colors, i.e., black, cyan, magenta and yellow are formed on the peripheral surfaces of respective of the four photoreceptor drums 1.

The developing device 4 is configured to supply a toner of black, which is the color associated with the image forming station 31, onto the peripheral surface of the photoreceptor drum 1 of the image forming station 31, thereby visualizing the electrostatic latent image into a toner image.

An outer peripheral surface of the intermediate transfer belt 51 becomes opposed to the four photoreceptor drums 1 sequentially. The intermediate transfer roller 5 is opposed to the photoreceptor drum 1 across the intermediate transfer belt 51. The position at which the intermediate transfer belt 51 and the photoreceptor drum 1 are opposed to each other is a primary transfer position.

The intermediate transfer roller 5 is applied with a primary transfer bias having a polarity (e.g., positive) opposite to the polarity (e.g., negative) of the toner charged by constant voltage control. The same holds true for the image forming stations 32 to 34. Thus, toner images of the respective colors formed on the respective photoreceptor drums 1 are primarily transferred onto the outer peripheral surface of the intermediate transfer belt 51 so as to be superimposed on one another, thereby forming a full-color image on the outer peripheral surface of the intermediate transfer belt 51.

In cases where only some of the image data items corresponding to black, cyan, magenta and yellow are inputted, of the four photoreceptor drums 1 only those photoreceptor drums 1 which are associated with the colors corresponding to the image data items inputted form electrostatic latent images and then toner images. Therefore, only the toner images of some of the colors are primarily transferred onto the outer peripheral surface of the intermediate transfer belt 51.

The cleaner unit 6 recovers residual toner that remains on the peripheral surface of the photoreceptor drum 1 after the primary transfer operation.

The toner images primarily transferred onto the outer peripheral surface of the intermediate transfer belt 51 at the respective primary transfer positions are fed by revolution of the intermediate transfer belt 51 to a secondary transfer position at which the intermediate transfer belt 51 and a secondary transfer belt 61 of the secondary transfer unit 60 are opposed to each other.

The sheet feeding portion 80 includes a sheet feed cassette 81, a manual feed tray 82, a first sheet feed path 83, and a second sheet feed path 84. Each of the sheet feed cassette 81 and the manual feed tray 82 accommodates recording sheets therein. The first sheet feed path 83 is formed to extend from the sheet feed cassette 81 and the manual feed tray 82 to the sheet output portion 90 via the secondary transfer position and the fixing device 70. The second sheet feed path 84 is a sheet feed path for double-side printing which is configured to feed a recording sheet bearing an image formed on one side thereof to the secondary transfer position again with the recording sheet turned upside down.

The secondary transfer unit 60 includes a secondary transfer roller 62 as well as the secondary transfer belt 61. The secondary transfer roller 62 is pressed against the intermediate transfer belt driving roller 52 across the secondary transfer belt 61 and the intermediate transfer belt 51 at a predetermined nip pressure. For keeping the nip pressure between the secondary transfer roller 62 and the intermediate transfer belt 51 at a predetermined value, one of the secondary transfer roller 62 and the intermediate transfer belt driving roller 52 comprises a hard material (e.g., metal or resin) and the other comprises a soft material (e.g., elastic rubber or expanded resin).

At the time of passage of a recording sheet through the secondary transfer position, the secondary transfer roller 62 is applied with a secondary transfer bias having a polarity (e.g., positive) opposite to the polarity (e.g., negative) of the toner charged by constant voltage control. Thus, the toner image born on the outer peripheral surface of the intermediate transfer belt 51 is secondarily transferred onto the recording sheet.

Residual toner that remains on the intermediate transfer belt 51 after the toner image has been transferred onto the recording sheet is recovered by an intermediate transfer belt cleaning unit 55.

The recording sheet to which the toner image has been transferred is fed to the fixing device 70. The fixing unit 70 includes a fixing roller 71 and a pressurizing roller 72. The fixing unit 70 is configured to carry out a fixing process for firmly fixing the toner image to the recording sheet by heating and pressurizing the recording sheet by rotating the fixing roller 71 and the pressurizing roller 72 with the recording sheet nipped therebetween.

The sheet output portion 90 has a sheet output tray 91 and sheet output rollers 92. The recording sheet bearing the toner image thus fixed thereto is outputted onto the sheet output tray 91 by the sheet output rollers 92. The sheet output tray 91 receives the recording sheet with its side bearing the toner image fixed thereto being oriented down.

Figure 2:
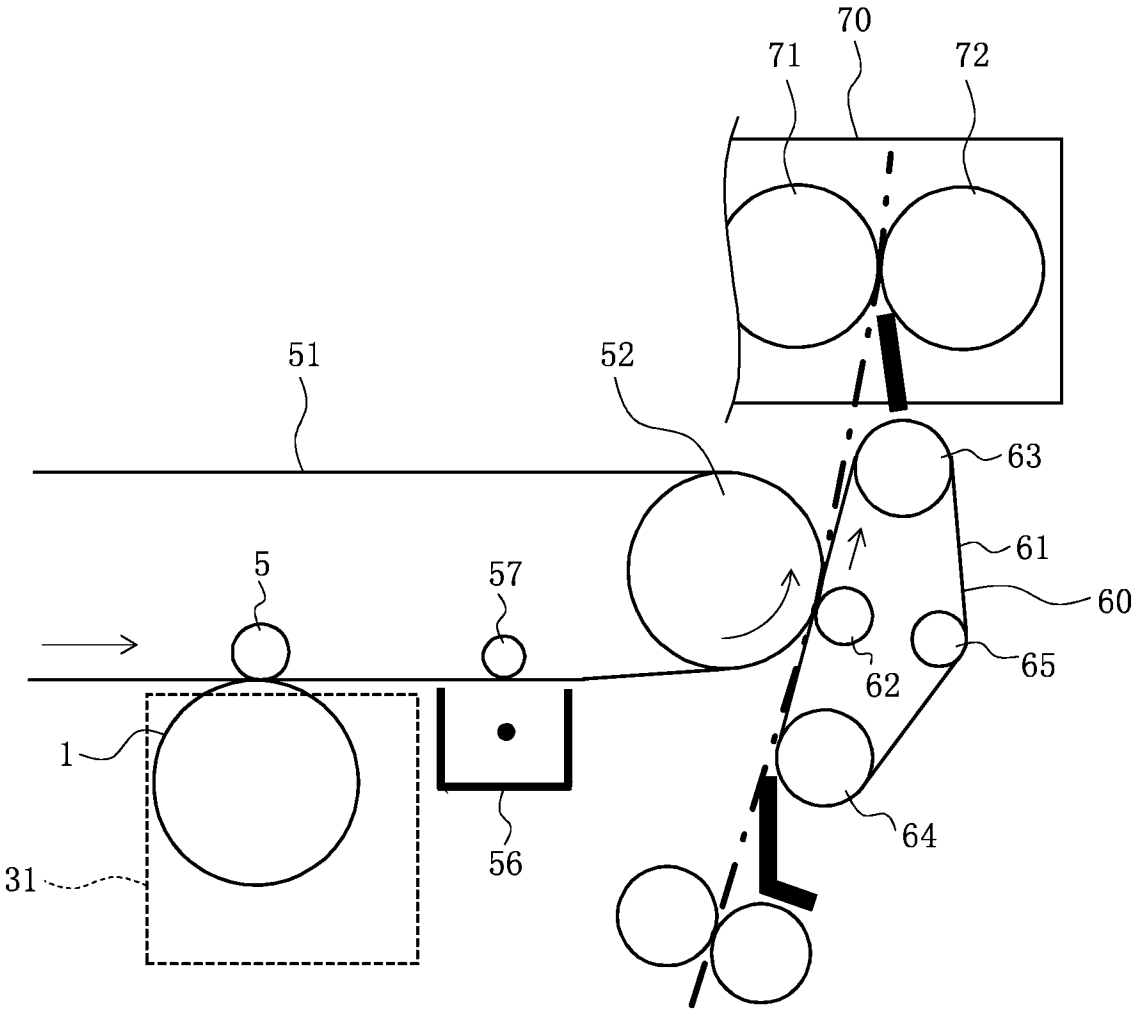
FIG. 2 is a partially enlarged view of the image forming apparatus.

Referring to FIG. 2, a pre-transfer charger (PTC) 56 is disposed between the intermediate transfer belt driving roller 52 and the black image forming station 31 located most downstream of the image forming stations 31 to 34 in the running direction of the intermediate transfer belt 51. The pre-transfer charger 56 faces the outer peripheral surface of the intermediate transfer belt 51. A counter roller 57 is disposed so as to be opposed to the pre-transfer charger 56 across the intermediate transfer belt 51. The pre-transfer charger 56 adjusts the amount of electrostatic charge on the toner forming the toner image born on the outer peripheral surface of the intermediate transfer belt 51 before the secondary transfer. This improves the image quality of the toner image transferred onto the recording sheet.

The secondary transfer unit 60 includes, in addition to the secondary transfer belt 61 and the secondary transfer roller 62, a secondary transfer belt driving roller 63, a secondary transfer belt idle roller 64, and a secondary transfer belt tension roller 65. The secondary transfer belt 61 is an endless belt which comprises a rubber material having a stretch property.

The secondary transfer roller 62, secondary transfer belt driving roller 63, secondary transfer belt idle roller 64 and a secondary transfer belt tension roller 65 are entraining rollers which entrain the secondary transfer belt 61 thereabout. The tension of the secondary transfer belt 61 can be varied by the secondary transfer belt tension roller 65.

Figure 3:
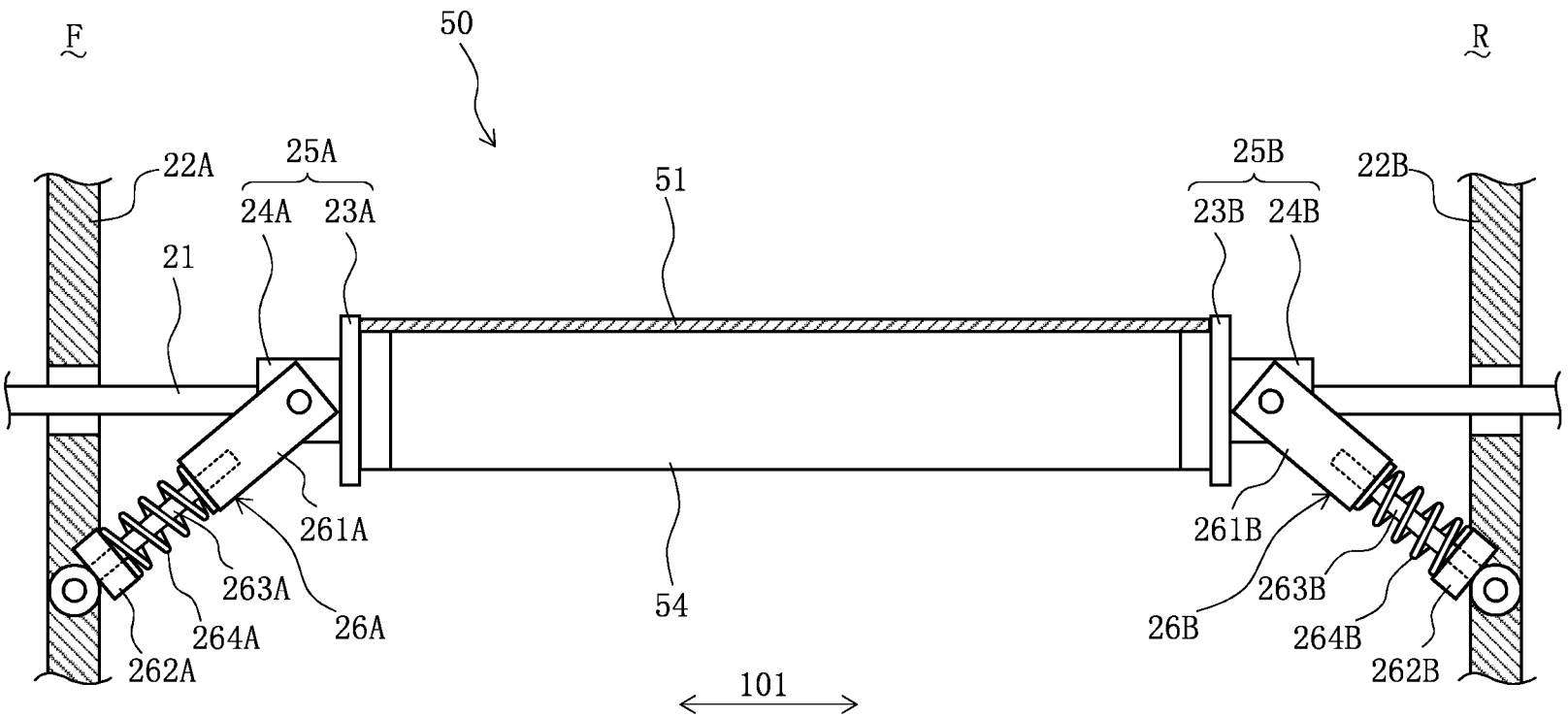
FIG. 3 is a sectional side elevational view of the intermediate transfer unit.

Referring to FIG. 3, the intermediate transfer belt tension roller 54 entraining the intermediate transfer belt 51 is supported by the shaft member 21 for rotation about the shaft member 21 and for sliding along the shaft member 21. The shaft member 21 is supported on apparatus frames 22A and 22B in such a manner that the opposite end portions of the shaft member 21 are independently movable in such a direction as to vary the tension of the intermediate transfer belt 51, namely, in the vertical direction in FIG. 3. The shaft member 21 is restrained from rotating. In FIG. 3 for example, the left-hand side is the front side F of the image forming apparatus 100 and the right-hand side is the rear side R of the image forming apparatus 100.

Larger-diameter members 23A and 23B are disposed so as to adjoin respective of the opposite ends of the intermediate transfer belt tension roller 54 in an axial direction 101 of the intermediate transfer belt tension roller 54. The larger-diameter members 23A and 23B each has a larger-diameter portion at a distal end located farther from the intermediate transfer belt tension roller 54 than the opposite end, the larger-diameter portion being larger in diameter than the intermediate transfer belt tension roller 54. The portion of each of the larger-diameter members 23A and 23B other than the larger-diameter portion which extends in the axial direction 101 has the same diameter as the intermediate transfer belt tension roller 54. The larger-diameter members 23A and 23B are fitted over the shaft member 21 for sliding in the axial direction 101 and for rotation about the shaft member 21.

A slide member 24A is disposed on the opposite side away from the intermediate transfer belt tension roller 54 with respect to the larger-diameter member 23A in the axial direction 101. Similarly, a slide member 24B is disposed on the opposite side away from the intermediate transfer belt tension roller 54 with respect to the larger-diameter member 23B in the axial direction 101. The slide members 24A and 24B are fitted over the shaft member 21 in such a manner as to adjoin the larger-diameter members 23A and 23B, respectively, and are slidable in the axial direction 101. The slide members 24A and 24B are restrained from rotating about the shaft member 21. The larger-diameter member 23A and the slide member 24A form one deviation transfer member 25A, while the larger-diameter member 23B and the slide member 24B form the other deviation transfer member 25B.

The intermediate transfer unit 50 further includes biasing members 26A and 26B. The biasing member 26A includes a first bracket 261A, a second bracket 262A, a stem 263A, and an elastic member 264A. The first bracket 261A is pivotally supported on the slide member 24A. The second bracket 262A is pivotally supported on the apparatus frame 22A at a predetermined position opposite away from the intermediate transfer belt tension roller 54 with respect to the pivot point of the first bracket 261A in the axial direction 101. That is, the biasing member 26A has an acting end and a base end pivotally supported on the apparatus frame 22A at the predetermined position which is closer to the associated end of the shaft member 21 than the acting end in the axial direction 101.

The stem 263A has one end fixed to one of the first and second brackets 261A and 262A and the other end displaceably inserted into the other bracket. For instance, the stem 263A has one end fixed to the second bracket 262A and the other end displaceably inserted into the first bracket 261A. The elastic member 264A intervenes between the first bracket 261A and the second bracket 262A. Since the elastic member 264A expands and contracts along the stem 263A, the direction of the elastic force fails to distort even when the degree of contraction becomes high.

The biasing member 26B includes a first bracket 261B, a second bracket 262B, a stem 263B, and an elastic member 264B. The biasing member 26B is similar in structure to the biasing member 26A. The first bracket 261B is pivotally supported on the slide member 24B. The second bracket 262B is pivotally supported on the apparatus frame 22B at a predetermined position opposite away from the intermediate transfer belt tension roller 54 with respect to the pivot point of the first bracket 261B. That is, the biasing member 26B has an acting end and a base end pivotally supported on the apparatus frame 22B at the predetermined position which is closer to the associated end of the shaft member 21 than the acting end in the axial direction 101.

As shown, the biasing member 26A is inclined in such a direction as to become closer to the slide member 24A as it extends from the side close to the associated end of the shaft member 21 toward a central portion of the shaft member 21 in the axial direction 101 of the intermediate transfer belt tension roller 54. Likewise, the biasing member 26B is inclined in such a direction as to become closer to the slide member 24B as it extends from the side close to the associated end of the shaft member 21 toward a central portion of the shaft member 21 in the axial direction 101 of the intermediate transfer belt tension roller 54.

The pivot points of the respective second brackets 262A and 262B are located on the opposite side away from the intermediate transfer belt 51 with respect to the shaft member 21. Therefore, the biasing members 26A and 26B bias the shaft member 21 in such a direction as to increase the tension of the intermediate transfer belt 51.

Figure 4:
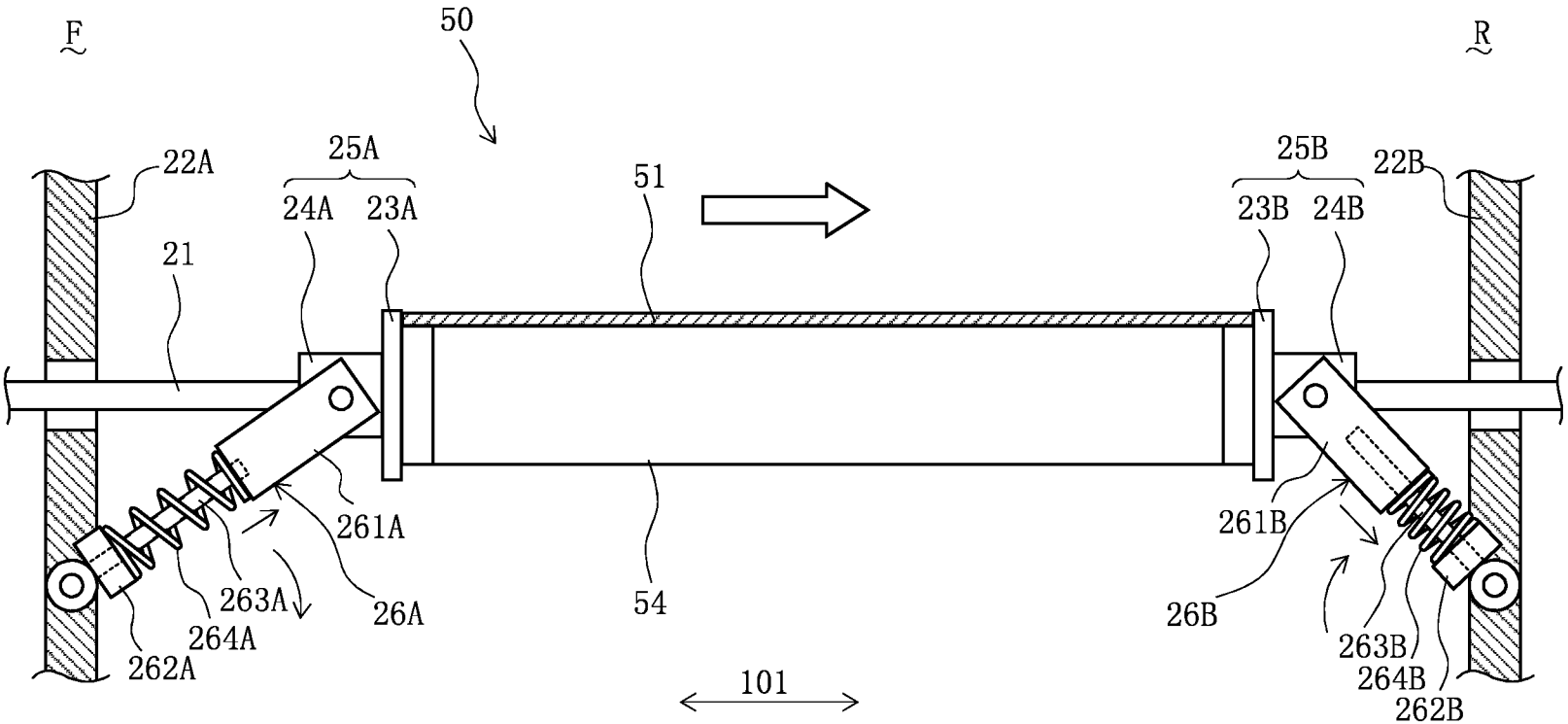
FIG. 4 is a view illustrating a state in which an intermediate transfer belt is deviated toward the rear side.

FIG. 4 illustrates a state in which the intermediate transfer belt 51 is deviated from an ideal widthwise position which has to be assumed by the intermediate transfer belt 51 during running, that is, a state in which the intermediate transfer belt 51 is meandering. When the intermediate transfer belt 51 meanders to deviate toward one side in the axial direction 101, e.g., toward the rear side R, a widthwise edge of the intermediate transfer belt 51 presses against the larger-diameter portion of the larger-diameter member 23B, thereby moving the deviation transfer member 25B, which is located on the downstream side in the deviation direction, toward the rear side R along the shaft member 21.

Thus, the angle of inclination of the biasing member 26B on the downstream side in the deviation direction relative to the axial direction 101 becomes closer to the angle perpendicular to the axial direction 101, causing the degree of contraction of the biasing member 26B to increase. Therefore, the pressing force of the biasing member 26B against the shaft member 21 increases, thereby causing the tension of the intermediate transfer belt 51 to increase on the downstream side in the deviation direction of the intermediate transfer belt 51 along the axial direction 101 of the intermediate transfer belt tension roller 54, i.e., on the rear side R.

The deviation transfer member 25A located on the upstream side in the deviation direction, on the other hand, moves toward the downstream side in the deviation direction by the elastic force of the biasing member 26A with deviation of the intermediate transfer belt 51. Thus, the angle of inclination of the biasing member 26A on the upstream side in the deviation direction relative to the axial direction 101 becomes closer to the angle of the axial direction 101, causing the degree of contraction of the biasing member 26A to decrease. Therefore, the pressing force of the biasing member 26A against the deviation transfer member 25A decreases, thereby causing the tension of the intermediate transfer belt 51 to decrease on the upstream side in the deviation direction of the intermediate transfer belt 51 along the axial direction 101.

Because an endless belt having no stretch property has the nature such that the endless belt moves from a high tension side toward a low tension side, the intermediate transfer belt 51 moves toward the front side F. In this way, the meandering of the intermediate transfer belt 51 toward the rear side R is corrected.

Figure 5:
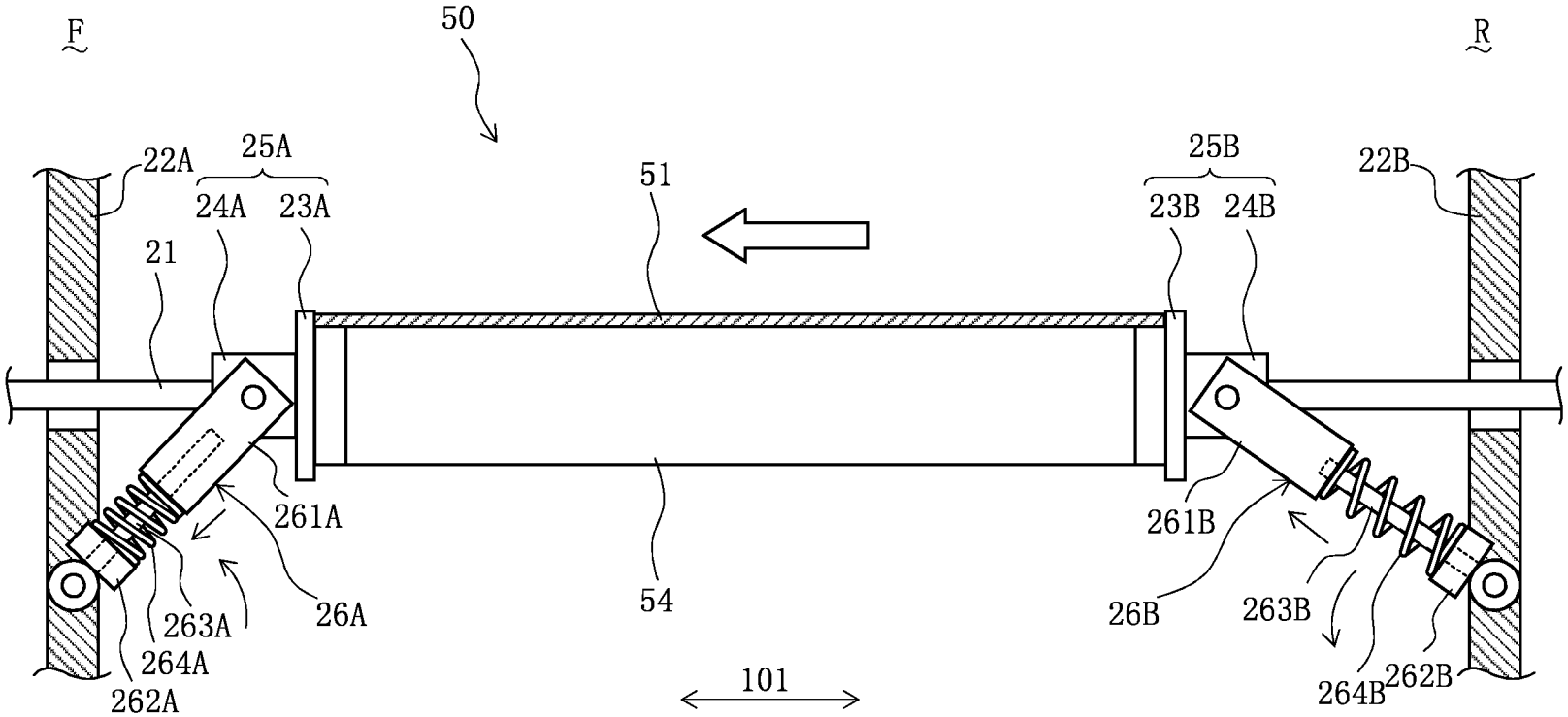
FIG. 5 is a view illustrating a state in which the intermediate transfer belt is deviated toward the front side.

FIG. 5 illustrates a state in which the intermediate transfer belt 51 is meandering toward the front side F. As in the case of FIG. 4, when the intermediate transfer belt 51 meanders to deviate toward the front side F, a widthwise edge of the intermediate transfer belt 51 presses against the larger-diameter portion of the larger-diameter member 23A, thereby moving the deviation transfer member 25A, which is located on the downstream side in the deviation direction, i.e., on the front side F, toward the front side F along the shaft member 21. Thus, the degree of contraction of the biasing member 26A on the downstream side in the deviation direction increases, thereby causing the tension of the intermediate transfer belt 51 to increase on the front side F. On the upstream side in the deviation direction, i.e., on the rear side R, the tension of the intermediate transfer belt 51 decreases. Therefore, the intermediate transfer belt 51 moves toward the rear side R. In this way, the meandering of the intermediate transfer belt 51 toward the front side F is corrected.

As described above, when the intermediate transfer belt 51 meanders to press against the larger-diameter portions of the larger-diameter members 23A and 23B, the intermediate transfer belt 51 is imparted with an increased tension on the downstream side in the deviation direction and a decreased tension on the upstream side in the deviation direction. For this reason, the intermediate transfer belt 51 is held in a widthwise position at which the force to move the intermediate transfer belt 61 toward the front side F and the force to move the intermediate transfer belt 61 toward the rear side R are balanced with each other. Therefore, the meandering of the intermediate transfer belt 51 of the intermediate transfer unit 50 can be stably corrected by means of a simple mechanism.

Further, the meandering of the intermediate transfer belt 51 can be corrected by means of a simple mechanism which does not need any sensor or electric circuit for detecting the amount of deviation of the intermediate transfer belt 51.

The pivoting direction of the biasing member 26A about the pivot point of the second bracket 262A and that of the biasing member 26B about the pivot point of the second bracket 262B are different from the running direction of that portion of the intermediate transfer belt 51 which presses against the intermediate transfer belt tension roller 54. Therefore, even when the amount of deviation of the intermediate transfer belt 51 becomes considerably large, the biasing members 26A and 26B fail to pivot by the force of the intermediate transfer belt 51 running. For this reason, the tension imparted by the intermediate transfer belt tension roller 54 to the intermediate transfer belt 51 cannot be undesirably weakened to an extreme. Thus, the meandering of the intermediate transfer belt 51 can be corrected stably.

The plane containing the loci of the biasing members 26A and 26B pivoting about their respective base end portions is preferably perpendicular to the running direction of the portion of the intermediate transfer belt 51 which presses against the intermediate transfer belt tension roller 54. This feature makes it possible to prevent the biasing members 26A and 26B from pivoting by the force of the intermediate transfer belt 51 running more reliably even when the amount of deviation of the intermediate transfer belt 51 becomes considerably large. Therefore, the meandering of the intermediate transfer belt 51 can be corrected more stably.

Since the larger-diameter members 23A and 23B are rotatable, the friction between the intermediate transfer belt 51 and the larger-diameter members 23A and 23B is reduced, which will reduce wear of the opposite edges of he intermediate transfer belt 51.

Of the deviation transfer members 25A and 25B, at least the deviation transfer member which is located on the downstream side in the deviation direction along the axial direction of the intermediate transfer belt 51 moves along the axial direction 101 together with the intermediate transfer belt 51. This feature exerts the effect of correcting the meandering of the intermediate transfer belt 51. By allowing the deviation transfer member which is located on the upstream side in the deviation direction to move along the axial direction 101 together with the intermediate transfer belt 51, the meandering of the intermediate transfer belt 51 can be corrected more effectively.

The larger-diameter members 23A and 23B may be formed integrally with the intermediate transfer belt tension roller 54.

Figure 6:
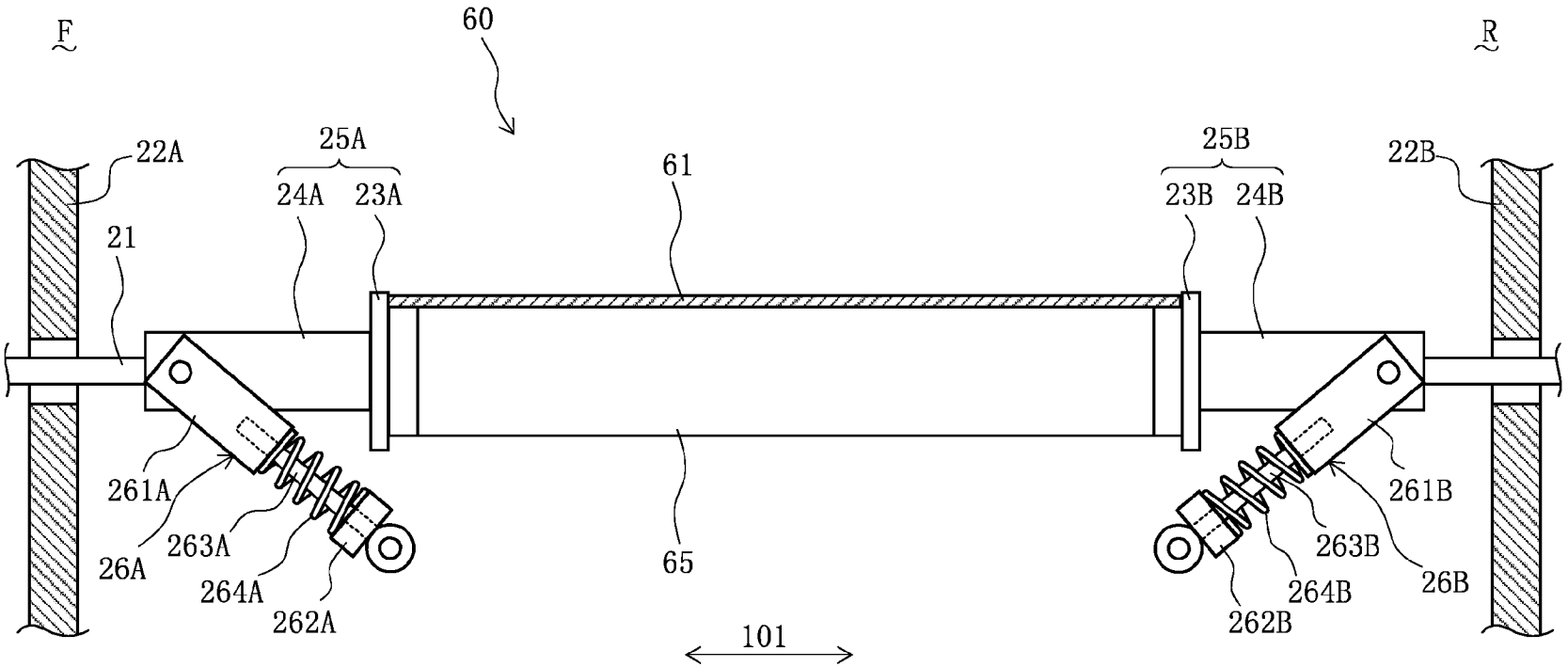
FIG. 6 is a sectional side elevational view illustrating a secondary transfer unit.
Figure 7:
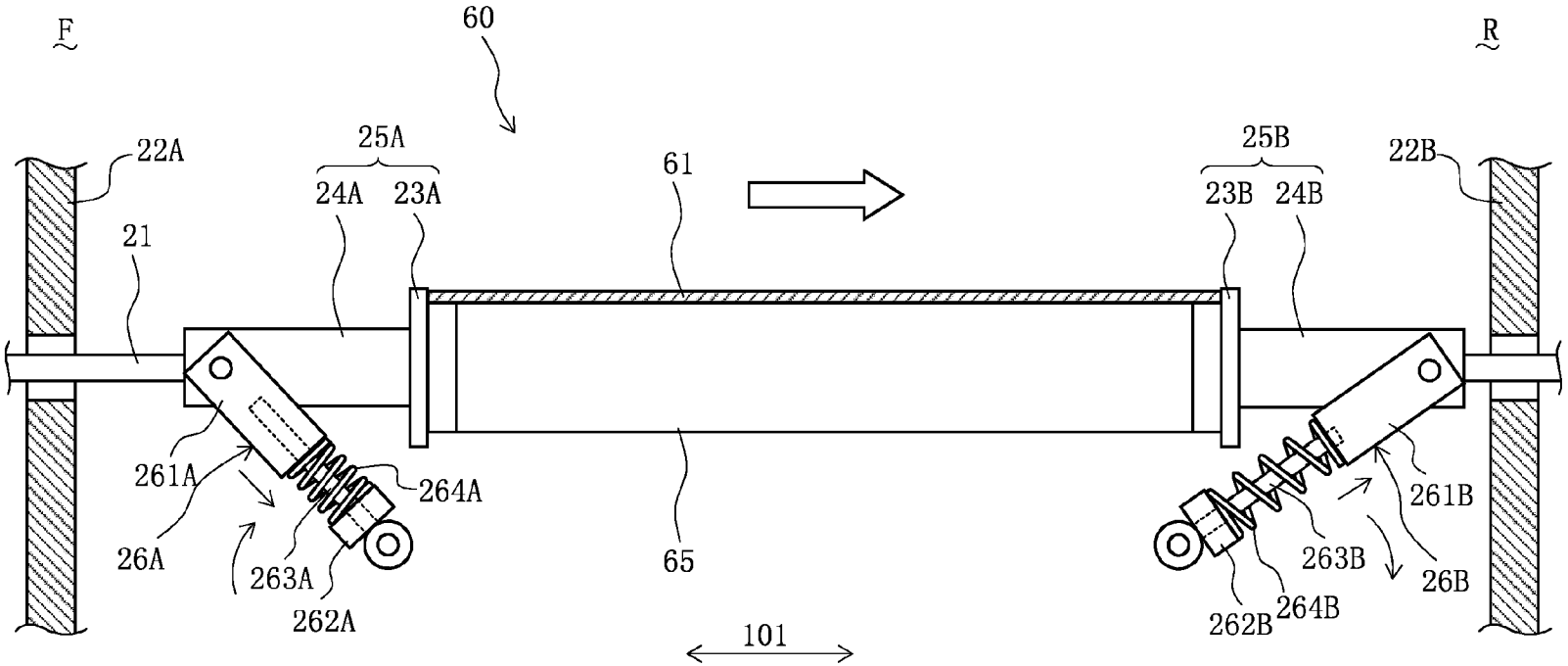
FIG. 7 is a view illustrating a state in which a secondary transfer belt is deviated toward the rear side.
Figure 8:
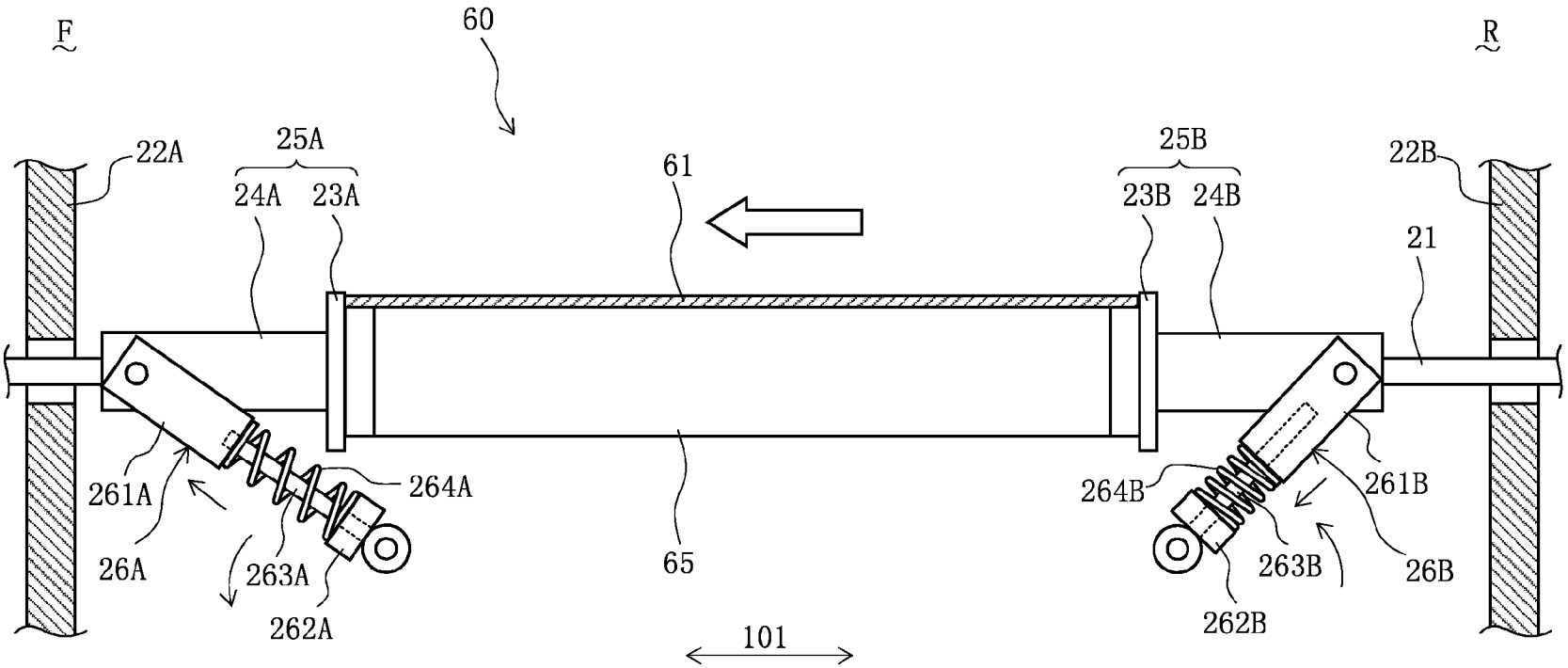
FIG. 8 is a view illustrating a state in which the secondary transfer belt is deviated toward the front side.

The belt driving device according to the present invention is applicable to the secondary transfer unit 60. In FIGS. 6 to 8, like reference characters as used in FIGS. 3 to 5 designate members or components like the corresponding members or components of the embodiment shown in FIGS. 3 to 5 for convenience.

Referring to FIG. 6, the secondary transfer belt tension roller 65 entraining the secondary transfer belt 61 is supported by the shaft member 21 for rotation about the shaft member 21 and for sliding along the shaft member 21. The shaft member 21 is supported on the apparatus frames 22A and 22B in such a manner that the opposite end portions of the shaft member 21 are independently movable in such a direction as to vary the tension of the secondary transfer belt 61, namely, in the vertical direction in FIG. 6. The shaft member 21 is restrained from rotating. In FIG. 6 for example, the left-hand side is the front side F of the image forming apparatus 100 and the right-hand side is the rear side R of the image forming apparatus 100.

The larger-diameter members 23A and 23B are disposed in such a manner as to adjoin respective of the opposite ends of the secondary transfer belt tension roller 65 in the axial direction 101 of the secondary transfer belt tension roller 65.

The slide member 24A is disposed on the opposite side away from the secondary transfer belt tension roller 65 with respect to the larger-diameter member 23A in the axial direction 101. Similarly, the slide member 24B is disposed on the opposite side away from the secondary transfer belt tension roller 65 with respect to the larger-diameter member 23B in the axial direction 101.

The secondary transfer unit 60 further includes the biasing members 26A and 26B. The biasing member 26A includes the first bracket 261A, second bracket 262A, stem 263A, and elastic member 264A. The first bracket 261A is pivotally supported on the slide member 24A. The second bracket 262A is pivotally supported on the apparatus frame 22A at a predetermined position on the same side as the secondary transfer belt tension roller 65 with respect to the pivot point of the first bracket 261A in the axial direction 101. That is, the biasing member 26A has an acting end and a base end pivotally supported on the apparatus frame 22A at the predetermined position which is closer to the central portion of the shaft member 21 than the acting end in the axial direction 101. Note that that portion of the apparatus frame 22A which supports the second bracket 262A for pivotal movement is not shown in FIGS. 6 to 8. The same holds true for the apparatus frame 22B.

The biasing member 26B includes the first bracket 261B, second bracket 262B, stem 263B, and elastic member 264B and is similar in structure to the biasing member 26A. The first bracket 261B is pivotally supported on the slide member 24B. The second bracket 262B is pivotally supported on the apparatus frame 22B at a predetermined position on the same side as the secondary transfer belt tension roller 65 with respect to the pivot point of the first bracket 261B. That is, the biasing member 26B has an acting end and a base end pivotally supported on the apparatus frame 22B at the predetermined position which is closer to the central portion of the shaft member 21 than the acting end in the axial direction 101.

As shown, the biasing member 26A is inclined in such a direction as to become closer to the slide member 24A as it extends from the side close to the central portion of the shaft member 21 toward the associated end of the shaft member 21 in the axial direction 101 of the second transfer belt tension roller 65. Likewise, the biasing member 26B is inclined in such a direction as to become closer to the slide member 24B as it extends from the side close to the central portion of the shaft member 21 toward the associated end of the shaft member 21 in the axial direction 101 of the secondary transfer belt tension roller 65.

The pivot points of the respective second brackets 262A and 262B are located on the opposite side away from the secondary transfer belt 61 with respect to the shaft member 21. Therefore, the biasing members 26A and 26B bias the shaft member 21 in such a direction as to increase the tension of the secondary transfer belt 61.

FIG. 7 illustrates a state in which the secondary transfer belt 61 is deviated from an ideal widthwise position which has to be assumed by the secondary transfer belt 61 during running, that is, a state in which the secondary transfer belt 61 is meandering. When the secondary transfer belt 61 meanders to deviate toward one side in the axial direction 101, e.g., toward the rear side R, a widthwise edge of the secondary transfer belt 61 presses against the larger-diameter portion of the larger-diameter member 23B, thereby moving the deviation transfer member 25B, which is located on the downstream side in the deviation direction, toward the rear side R along the shaft member 21.

Thus, the angle of inclination of the biasing member 26B located on the downstream side in the deviation direction relative to the axial direction 101 becomes closer to the angle of the axial direction 101, causing the degree of contraction of the biasing member 26B to decrease. Therefore, the pressing force of the biasing member 26B against the shaft member 21 decreases, which causes the tension of the secondary transfer belt 61 to decrease on the downstream side in the deviation direction of the secondary transfer belt 61 along the axial direction 101 of the secondary transfer belt tension roller 65.

The deviation transfer member 25A located on the upstream side in the deviation direction is configured to move toward the downstream side in the deviation direction with deviation of the secondary transfer belt 61. Thus, the angle of inclination of the biasing member 26A located on the upstream side in the deviation direction relative to the axial direction 101 becomes closer to the angle perpendicular to the axial direction 101, causing the degree of contraction of the biasing member 26A to increase. Therefore, the pressing force of the biasing member 26A against the deviation transfer member 25A increases, which causes the tension of the secondary transfer belt 61 to increase on the upstream side in the deviation direction of the secondary transfer belt 61 along the axial direction 101.

Because an endless belt having a stretch property has the nature such that the endless belt moves from a low tension side toward a high tension side, the secondary transfer belt 61 moves toward the front side F. In this way, the meandering of the secondary transfer belt 61 toward the rear side R is corrected.

FIG. 8 illustrates a state in which the secondary transfer belt 61 is meandering toward the front side F. As in the case of FIG. 7, when the secondary transfer belt 61 meanders to deviate toward the front side F, a widthwise edge of the secondary transfer belt 61 presses against the larger-diameter portion of the larger-diameter member 23A, thereby moving the deviation transfer member 25A, which is located on the downstream side in the deviation direction, i.e., on the front side F, toward the front side F along the shaft member 21. Thus, the degree of contraction of the biasing member 26A located on the downstream side in the deviation direction decreases, which causes the tension of the secondary transfer belt 61 to decrease on the front side F. On the upstream side in the deviation direction, i.e., on the rear side R, the tension of the secondary transfer belt 61 increases. Therefore, the secondary transfer belt 61 moves toward the rear side R. In this way, the meandering of the secondary transfer belt 61 toward the front side F is corrected.

As described above, when the secondary transfer belt 61 meanders to press against the larger-diameter portions of the larger-diameter members 23A and 23B, the secondary transfer belt 61 is imparted with a decreased tension on the downstream side in the deviation direction and an increased tension on the upstream side in the deviation direction. For this reason, the secondary transfer belt 61 is held in a widthwise position at which the force to move the secondary transfer belt 61 toward the front side F and the force to move the secondary transfer belt 61 toward the rear side R are balanced with each other. Therefore, the meandering of the secondary transfer belt 61 of the secondary transfer unit 60 can be stably corrected by means of a simple mechanism.

It should be noted that the present invention is also applicable to a belt driving device for driving an endless belt having no stretch property other than the intermediate transfer belt 51 as well as to a belt driving device for driving an endless belt having a stretch property other than the secondary transfer belt 61. Such belt driving devices applied with the present invention are each capable of correcting the meandering of the endless belt.

The foregoing embodiments are illustrative in all points and should not be construed to limit the present invention. The scope of the present invention is defined not by the foregoing embodiments but by the following claims. Further, the scope of the present invention is intended to include all modifications within the scopes of the claims and within the meanings and scopes of equivalents.

What is claimed is:

1. A belt driving device comprising:

an endless belt;

a plurality of entraining rollers which entrain the endless belt thereabout and which include a driving roller for revolving the endless belt and a tension roller capable of varying a tension of the endless belt;

a shaft member supporting the tension roller for rotation and having opposite end portions which are independently movable in such a direction as to vary the tension of the endless belt;

deviation transfer members fitted over the shaft member in such a manner as to adjoin respective of opposite ends of the tension roller in an axial direction of the tension roller, at least that deviation transfer member which is located on a downstream side in a deviation direction of the endless belt along the axial direction being movable in the deviation direction with deviation of the endless belt; and biasing members each having an elastic force which biases the shaft member in such a direction as to increase the tension of the endless belt and each including an acting end pivotally supported on an associated one of the deviation transfer members and a base end pivotally supported on an associated one of apparatus frames at a predetermined position, wherein the deviation transfer members include respective larger-diameter members which are larger in diameter than the tension roller and which are rotatably supported on the shaft member.

2. The belt driving device according to claim 1, wherein the endless belt has no stretch property and;

wherein the base end is pivotally supported on the associated one of the apparatus frames at the predetermined position which is on an opposite side away from the tension roller with respect to the acting end in the axial direction.

3. The belt driving device according to claim 1, wherein the endless belt has a stretch property and;

wherein the base end is pivotally supported on the associated one of the apparatus frames at the predetermined position which is on the same side as the tension roller with respect to the acting end in the axial direction.

4. The belt driving device according to claim 1, wherein that deviation transfer member which is located on an upstream side in the deviation direction is movable in the deviation direction with the deviation of the endless belt.

5. A belt driving device comprising:

an endless belt;

a plurality of entraining rollers which entrain the endless belt thereabout and which include a driving roller for revolving the endless belt and a tension roller capable of varying a tension of the endless belt;

a shaft member supporting the tension roller for rotation and having opposite end portions which are independently movable in such a direction as to vary the tension of the endless belt;

deviation transfer members fitted over the shaft member in such a manner as to adjoin respective of opposite ends of the tension roller in an axial direction of the tension roller, at least that deviation transfer member which is located on a downstream side in a deviation direction of the endless belt along the axial direction being movable in the deviation direction with deviation of the endless belt; and biasing members each having an elastic force which biases the shaft member in such a direction as to increase the tension of the endless belt and each including an acting end pivotally supported on an associated one of the deviation transfer members and a base end pivotally supported on an associated one of apparatus frames at a predetermined position, wherein the endless belt has a stretch property; and the base end is pivotally supported on the associated one of the apparatus frames at the predetermined position which is on the same side as the tension roller with respect to the acting end in the axial direction.

6. The belt driving device according to claim 5, wherein that deviation transfer member which is located on an upstream side in the deviation direction is movable in the deviation direction with the deviation of the endless belt.

* * * * *